US008286391B2

(12) United States Patent
Yang et al.

(10) Patent No.: US 8,286,391 B2
(45) Date of Patent: Oct. 16, 2012

(54) PORTABLE BUILDING

(76) Inventors: Zhenqiu Yang, Zhangzhou (CN); Xiuyuan Yang, Zhangzhou (CN)

( * ) Notice: Subject to any disclaimer, the term of this patent is extended or adjusted under 35 U.S.C. 154(b) by 816 days.

(21) Appl. No.: 11/722,307

(22) PCT Filed: Dec. 20, 2005

(86) PCT No.: PCT/CN2005/002255

§ 371 (c)(1),
(2), (4) Date: Dec. 7, 2009

(87) PCT Pub. No.: WO2006/066501

PCT Pub. Date: Jun. 29, 2006

(65) Prior Publication Data

US 2010/0064599 A1 Mar. 18, 2010

(30) Foreign Application Priority Data

Dec. 20, 2004 (CN) ..... 2004 1 0075585

(51) Int. Cl.
*E04B 7/16* (2006.01)

(52) U.S. Cl. ..... 52/69; 52/64; 52/71; 52/66; 52/79.5; 52/79.12

(58) Field of Classification Search ..... 52/64, 66, 52/67, 69, 71, 79.5, 79.12, 122.1, 125.2, 52/125.3

See application file for complete search history.

(56) References Cited

U.S. PATENT DOCUMENTS

| | | | | |
|---|---|---|---|---|
| 3,866,365 | A * | 2/1975 | Honigman | 52/70 |
| 3,872,631 | A * | 3/1975 | Nowell | 52/67 |
| 4,780,996 | A * | 11/1988 | Julien, Jr. | 52/68 |
| 5,950,373 | A | 9/1999 | von Hoff et al. | |

FOREIGN PATENT DOCUMENTS

| | | |
|---|---|---|
| CN | 2511738 | 9/2002 |
| CN | 2547795 | 4/2003 |
| WO | 9320297 A1 | 10/1993 |

OTHER PUBLICATIONS

International Preliminary Report on Patentability, dated Jun. 26, 2007.
Written Opinion, dated Mar. 2, 2006.
International Search Report, dated Mar. 2, 2006.

* cited by examiner

*Primary Examiner* — William Gilbert
*Assistant Examiner* — Patrick Maestri
(74) *Attorney, Agent, or Firm* — Ostrager Chong Flaherty & Broitman P.C.

(57) ABSTRACT

This invention reveals a type of portable building, which includes a box which forms the main body of the building, the box being cubic in shape, at least one movable top plate that forms the roof of the building, one side of such movable top plate connecting to and pivoting on one side of the top panel of the box, and such top plate rotating around the pivot downwards to lean against the side panel of the box, at least one movable bottom panel that is provided for the bottom panel of the building, one side of the movable bottom panel connecting to and pivoting on one side of the bottom panel, and such bottom panel rotating around the pivot downwards to lean against the side panel of the box, the pivots of the bottom panel and the top plate are located on the same side panel of the box, at least one side plate is provided for the side wall of the building, the side plate that supports between the edge of the bottom plate and the edge of the top plate being vertical and knock-down. The building becomes a standard shipping container when it has been folded which adapts to land and sea transport and so is readily transported.

15 Claims, 8 Drawing Sheets

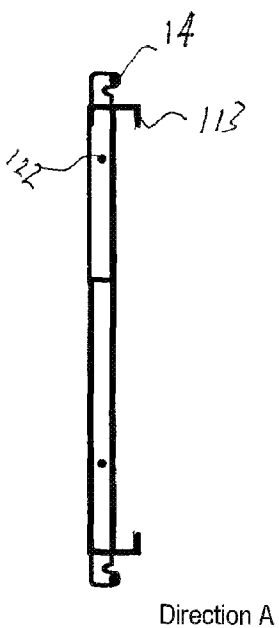
Figure 6-b
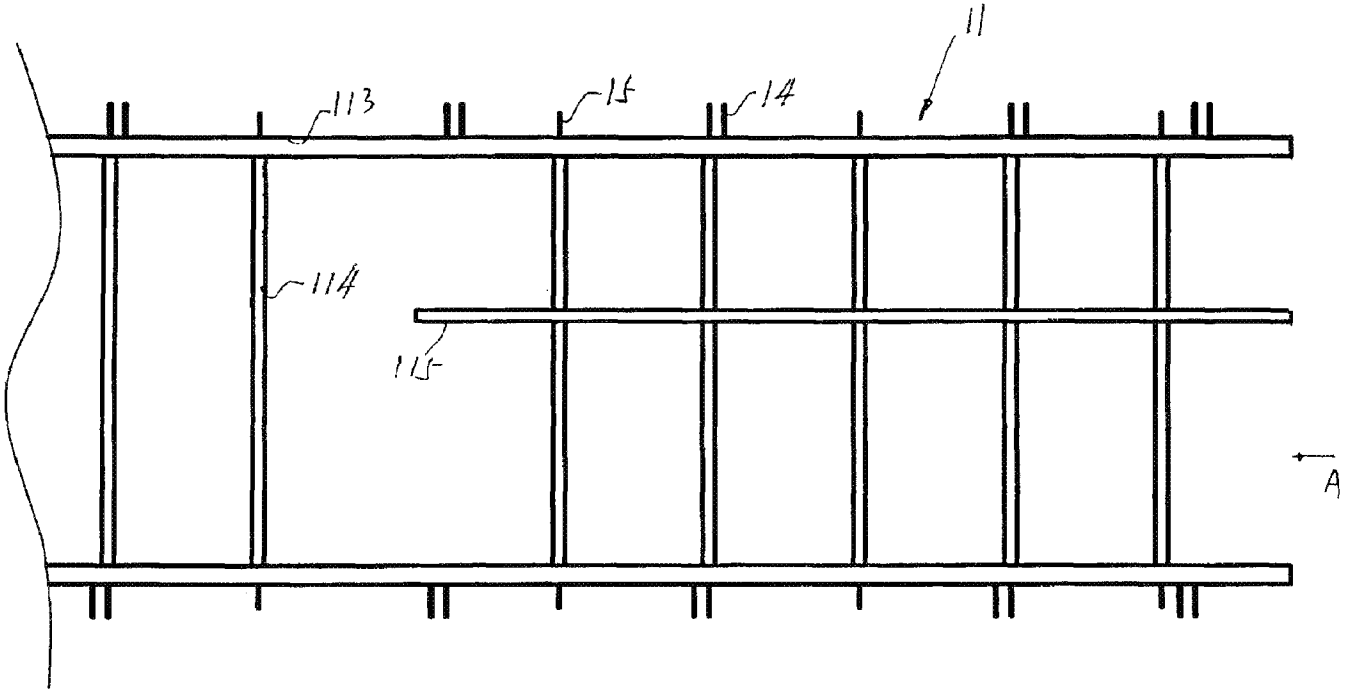
Figure 6-a

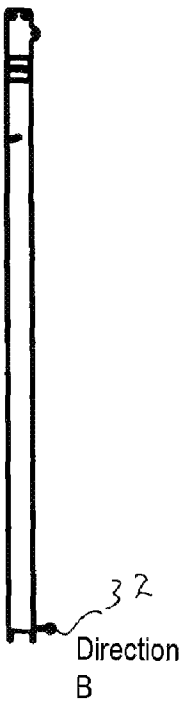
Figure 7-b
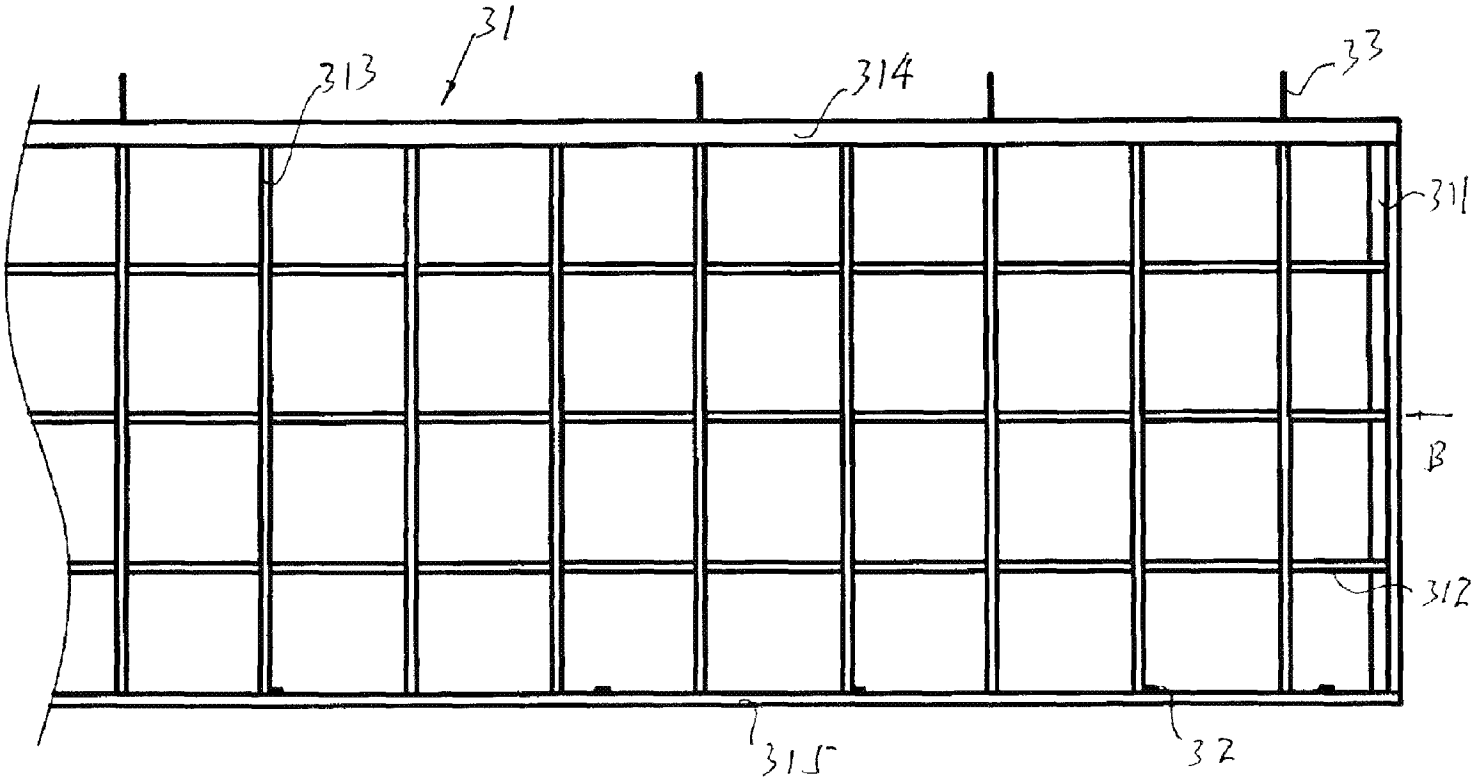
Figure 7-a

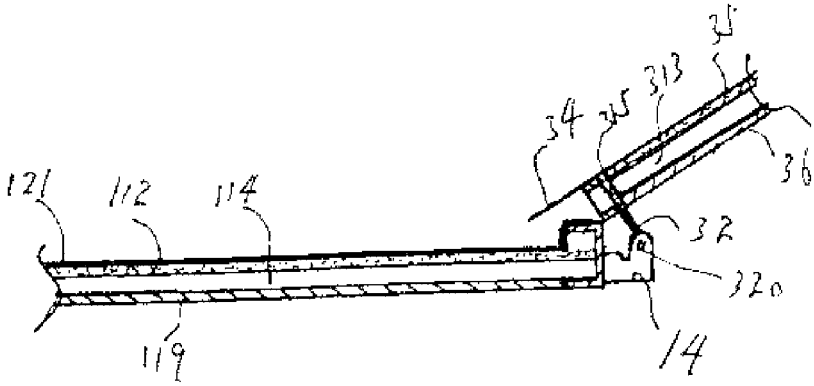
Figure 7-c
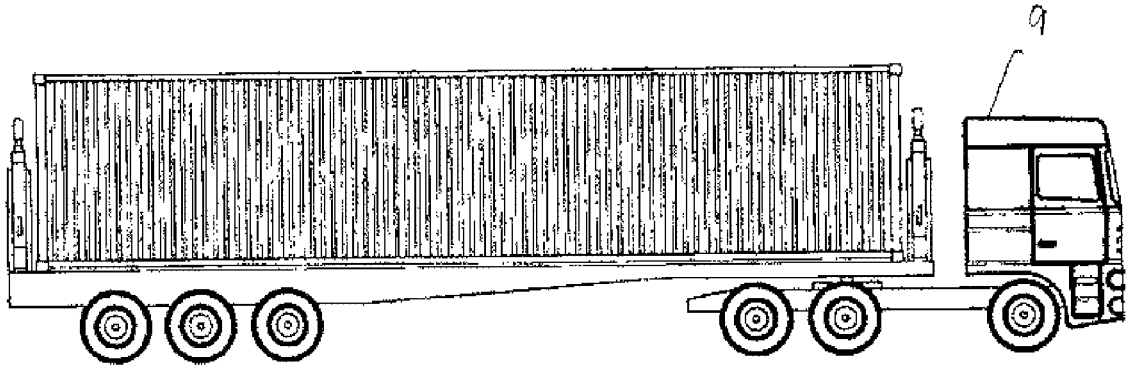
Figure 8

PORTABLE BUILDING

The present application is an English language translation of International Application PCT No. PCT/CN2005/002255, filed Dec. 20, 2005, which claims priority to Chinese Application No. 200410075585.X, filed Dec. 20, 2004; both applications are hereby incorporated by reference.

FIELD OF TECHNOLOGY

This invention relates to a portable building, and more specifically to a type of building that can be folded to form a standard shipping container and that can be readily transported.

PRIOR ART

Portable buildings are widely employed in many fields such as for villas in non-urban areas, as sales offices, residential apartments, exhibition rooms, command posts, schools, shops, dormitories, dining halls, industrial workshops, hospitals, police and so forth posts and additional storeys above existing buildings and so forth, and are characterized by being capable of being collapsed and then re-erected for ease of transportation from one site to another site; however, the deficiencies of portable buildings of the prior art are that the process of collapsing is cumbersome, expensive and time consuming, requiring many spare parts that are readily lost, that the portable buildings are not readily transported over long distances, and that the components are readily damaged when frequently collapsed so that the portable buildings can be reused relatively few times.

CN01249948 revealed a type of ultra-light collapsible decking structure portable building, such buildings including a foundation plate, walls, partitioning, bottom panels, roofing and rapid connection and tensioning devices; such buildings could be rapidly connected and tensioned employing standardized walls, sidings, bottom panels and roofs according to different design requirements, with the partitioning, bottom panels, roof and walls all employing multi-cavity composite internally stressed ultra-light, ultra-strong structures. While such buildings employed very light structural members and were relatively simple to collapse and transport, but they still suffered from the deficiencies aforementioned, namely that the process of collapsing the buildings was cumbersome, expensive and time-consuming and required many parts, the buildings were not easily transported over long distances, and the rate of reuse of the buildings was relatively low.

CN02278245 revealed a type of multi-function container expandable type portable building for camp activities, that consists of six members, a box body, walls, roof, roof truss, waterproof heat insulating tarpaulin and sole timbers, the box body employing two containers, left and right, to construct the body, the front and rear walls being joined by hinges to the studs at the four corners of the box body, each of the walls consisting of facings that can be folded over each other, there being sole timbers at the bottoms of the front and rear walls, the side walls being installed in the ends of the front and rear walls, there being no secondary wallboards between the bottoms of the front and rear wallboards and the sole timbers when a standard deformable shipping container is moved on rails, there being roof trusses over the spaces enclosed by the side wallboards and the front and rear wallboards, there being roofing over the roof trusses, the roof being composed of rolled or folded material, and there being waterproof and heat insulating tarpaulins over the roofing. Although such portable buildings are capable of being placed in containers for transportation, the process of erection is relatively cumbersome, the structure is insufficiently rigid, and the roof ridges still require the use of insulating tarpaulins in order to waterproof the buildings, which limits the service lives of the buildings and the waterproofing and windproofing effects are unsatisfactory.

DETAILED DESCRIPTION OF THE INVENTION

This invention provides a type of portable building, the principal objectives of the invention being to overcome the present problems of portable buildings, such as the cumbersome process of erection, the costs in labour and time, the many parts which are readily lost and broken, the difficulty of transport over long distances and the relatively rate of reuse of the buildings, and to provide a type of portable building that is complete, simple to erect and transport and that offers good waterproofing and windproofing effects when in use.

The present invention belongs to the field of technology of portable buildings, and includes:

a box that forms the principal member of the building, such box being a rectangular parallelepiped in outward appearance, and including at least four studs, four short transverse beams, and four lengthwise vertical beams that compose the framework of the box, with a top plate, with a fixed top plate at the top thereof and a fixed bottom panel at the base thereof, and fixing frames for the mounting of being provided at the tops of at least two of the studs;

at least one movable top plate that forms the roof of the building, one side of such top plate pivoting on one side of the roof surface of the box, and the top plate being capable of pivoting on the pivot and rolling downwards to lean against the side panel of the box;

at least one movable bottom panel that forms the floor of the buildings, one side of such bottom panel pivoting on one side of the floor surface of the box, and the bottom panel being capable of pivoting on the pivot and rolling upwards to lean against the side panel of the box, and the pivots of such bottom panel and the aforementioned top plate being located at the bottom and at the top of the same side panel of the box;

at least one side plate of the side wall of the structure being capable of being knocked down and being braced between the edges of the top plate and the bottom panel;

at least one lighting fixture, portion of the cabling thereof being required to have been previously embedded in the fixed top plate and portion leading into the movable top plate;

at least one water supply set, the drinking water and sewage pipes thereof being required to have been previously embedded in the fixed bottom panel;

at least two hoisting devices for opening and closing the movable top plate and the movable bottom plate, and for dismantling and erecting the frame on the studs;

the fixed top plate and movable top plate form the roof of the structure and include at least: waterproof outer layers, decorative inner layers and steel frames, with sealing strips at the junctions between the fixed top plate and the movable top plate;

the outer waterproof layer of the fixed top plate consists of fibreglass which is formed integrally with the top plate, and the two vertical sides of the outer waterproof layer form a concave trough with the two lengthwise vertical beams of the fixed top plate; the outer waterproof layer of the movable top plate consists of steel sheet which extends over the steel frame and the decorative inner layer and overlaps the fixed top plate in order to prevent the entry of rainwater.

For transport, the side plates are folded down and stowed in the box, the movable top plate and movable bottom plate are folded in against the side surfaces of the box and fixed, and the exterior of the structure forms the exterior of the box, resembling a shipping container and being readily assembled.

The aforementioned hoisting devices include booms, pulley blocks, steel cables and electrically powered blocks; the pulleys are disposed at the outer ends of the booms, the electrically powered blocks are mounted on columns below the fixed beams, a steel cable is coiled around the axis of revolution of the hoisting device, hooks are provided at the free ends of such steel cable, a further pulley is provided above the electrically powered block, the free ends of the steel cable pass through the two pulleys, and a hanger that is adapted to the aforementioned hook is provided in the top of the frame of the movable top plate.

The aforementioned fixing frame forms a pyramidal box, the thickness thereof being equal to the width of the studs, an insertion slot and a pin joint part are provided at the top of the top plate, an insertion knob is provided below the vicinity of the fixed end of the aforementioned boom, the insertion knob being inserted into the insertion slot, and the fixed end of the boom is then fixed to the pin joint through a pin.

When the movable top plate is opened (assembled to form the building) it appears inclined with the outer extended side being higher than the fixed side, the face of the top plate is a corrugated sheet that is provided with gutters that follow the inclination of the top plate, the top surface of the fixed top plate forms a concave trough, and the fixed side of the movable top plate is slightly higher than the top surface of the fixed top plate.

The interior of the portable building is provided with a kitchen, a bathroom and a parlour; the fixtures of the kitchen and the bathroom are all mounted in the main members and some may be fixed to the side panels, and the cabling for the power supply is installed in flexible conduits which are disposed in the side panels and head panels.

The decorative layers that are disposed on the insides of the movable top plate and the fixed plate are formed of aluminium alloy pinch plates, and heat insulating batts are disposed between the aluminium alloy pinch plates and the outer waterproof sheets.

The fixed bottom plates and movable bottom plates include successively erection frames, damp-proof sheets and timber sheet or bamboo sheet floorboards; they also include floorboard sealing strips which are placed in the joins between the fixed plates and movable bottom plates.

The outer dimensions of the box are similar to the outer dimensions of a standard shipping container.

The top sides and bottom sides of the two longer side surfaces of the box both pivot on the movable top plate and bottom plate, a door is provided at the top of one of the shorter side surfaces of the box, and window apertures are provided in the side plates.

A mounting for a wind turbine generator or alternatively a solar generator is provided on the top of the box, and a steel frame that connects to and integrates with the steel frame of the box is provided below the mounting, which is able to support the wind turbine generator or alternatively solar generator.

An environmentally friendly toilet is provided inside the box, which may be a water-free bioactive toilet.

The method prior to the movement of the building includes the following steps:

1. Dismantling the side plates of the side walls and placing them within the box which forms the main structure.
2. Rolling over the movable bottom plates of the roof and the floor and leaning them against the side surfaces of the box
3. Using transport equipment to move the shipping container to the desired location, and then
4. Rolling up the top plate that forms the roof of the structure to the set height and fixing it in place
5. Rolling down the bottom plate that forms the floor to the ground
6. Erecting the side plates that form the outer walls of the building to support the top plate and bottom plate The method of rolling up the top plate in the method prior to the movement of the building includes the following steps:

1. Installing a boom on the top of the fixed frame over two studs on one side of the box that forms the main component of the building
2. Mounting two electrically powered blocks on separate side surfaces of the studs of the box, passing the free ends of the wire ropes through the revolving shafts of the electrically powered blocks and through the rollers below the outer end of the boom, and attaching the free end of the wire rope to the hook on the top plate
3. Starting the electrically powered blocks to draw up the wire ropes and cause the top plate to rise smoothly and roll over and to dock with the lateral panels of the box.

The movable top plate is caused to smoothly roll over downwards in the same manner, and the same hoisting equipment is employed.

Because pulleys can be employed directly with the movable top plate, it can be raised and lowered with the electrically powered blocks.

To summarize the foregoing, the present invention differs from the prior art in the following ways: 1. After having been collapsed, the building forms a standard shipping container, suitable for transport by road or sea transport, and is therefore very convenient to transport; 2. The processes of disassembly and assembly of the building are very convenient, there are not excessive numbers of parts, the building does not require separate packing for transport after disassembly but itself forms a standard shipping container which contains all the fittings and windows; 3. Because the object is a shipping container for transport, the building can be relatively heavy and therefore steel structural elements or other relatively heavy structural elements may be employed for the supporting structure to ensure that it possesses sufficient strength; 4. The assembly and disassembly of the building may be performed mechanically; 5. The steel framework employed for the building is designed rationally and complies with the Standard GB50017-2003, Design Parameters for Steel Structures, and is rainproof, wind-proof and is able to withstand category 7 earthquakes; 6. Two layers of aluminium alloy are employed for the frames of the walls, which include reinforced glass and comply with the Standard GB/T15225-94, Physical Performance of Walls in Structures, can withstand Force 12 typhoons, possess good heat retention and can be employed in hot and very cold environments and can provide protection against radiation. The building also is provided with a lightning rod, electrical wiring and electrical earthing, with an earth resistance of less than 10Ω. 7. The building is provided with complete water and electrical equipment, and also is provided with an environmentally friendly toilet, and can be used as an office, residence or workshop and so forth, and is very convenient for living and working in; 8. The building may also be provided with a small wind turbine generator or solar generator and become self-sufficient for electricity.

In this invention, a movable top plate and a movable base plate may be installed in one side of the box to form a single-sided movable building, or movable top plates and movable base plates may be installed on both sides of the box in order to form a double-sided movable building; it is also possible to form a villa-type structure.

DESCRIPTION OF THE DRAWINGS

FIG. 6*a* is a drawing showing the steel framework of the fixed top plate of the invention.

FIG. 6*b* is a drawing showing the structure in direction A in FIG. 6*a*.

FIG. 7*a* is a drawing showing the steel framework of the movable top plate of the invention.

FIG. 7*b* is a drawing showing the structure in direction B in FIG. 7*a*.

FIG. 7*c* is a drawing showing the connecting mechanism between the movable top plate and the fixed top plate of the invention.

FIG. 8 is a drawing of the invention after disassembly and after loading onto a transport vehicle.

MODE OF IMPLEMENTATION

Figure 1:
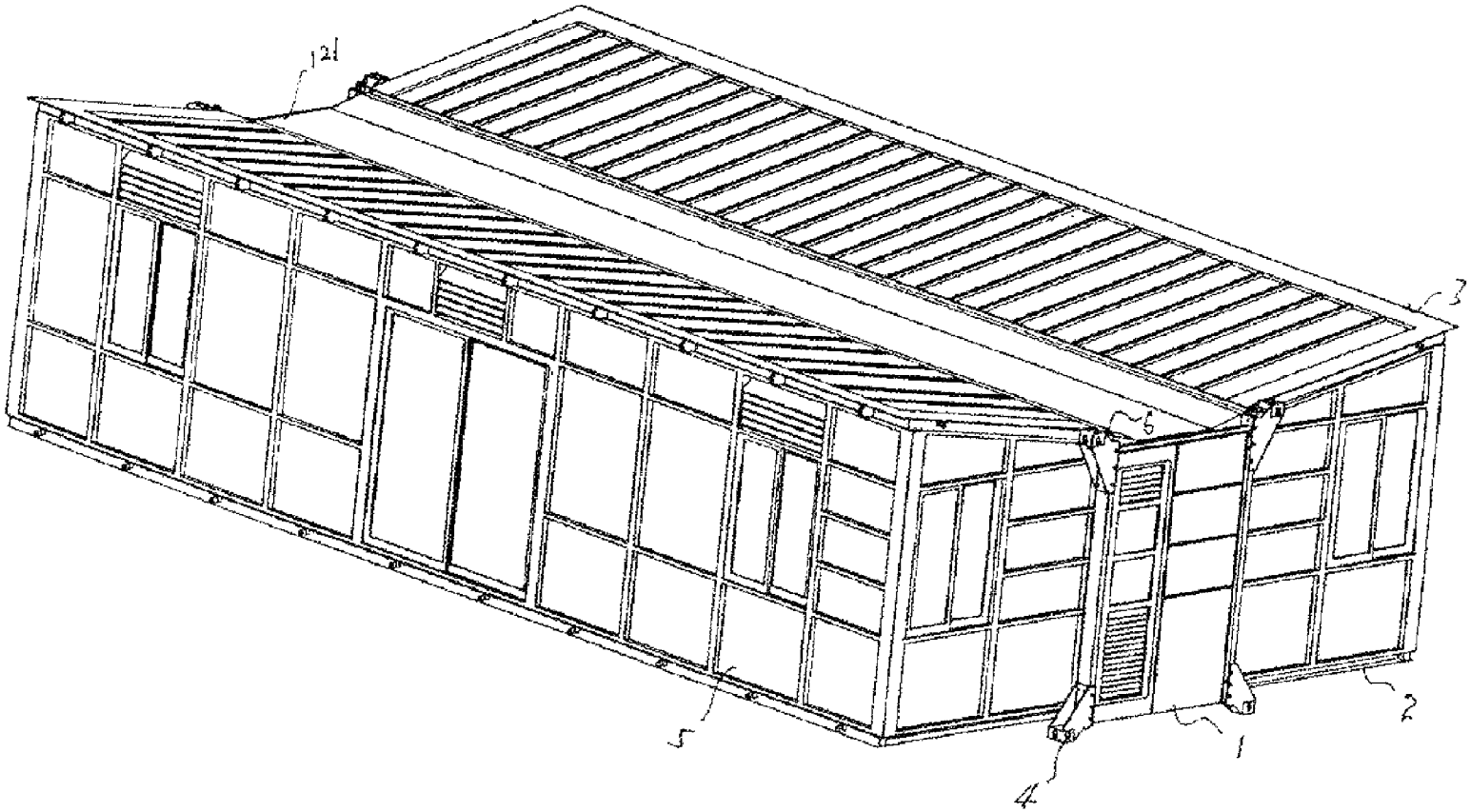
FIG. 1 is a three-dimensional structural drawing showing the invention in use.

The mode of implementation of the invention includes importantly the box 1 which is the principal structural body, movable top plates 3 for both sides that pivot on the top panel of the box, movable bottom plates 2 for both sides that pivot on the bottom panel of the box, side plates 5 that are disposed between the movable top plates 3 and movable top plates 3 are fixed to the stand bar 4 in the bottom of the box 1 and are fixed to the fixing frame 6 of the hoisting device at the top of the box 1.

Figure 2:
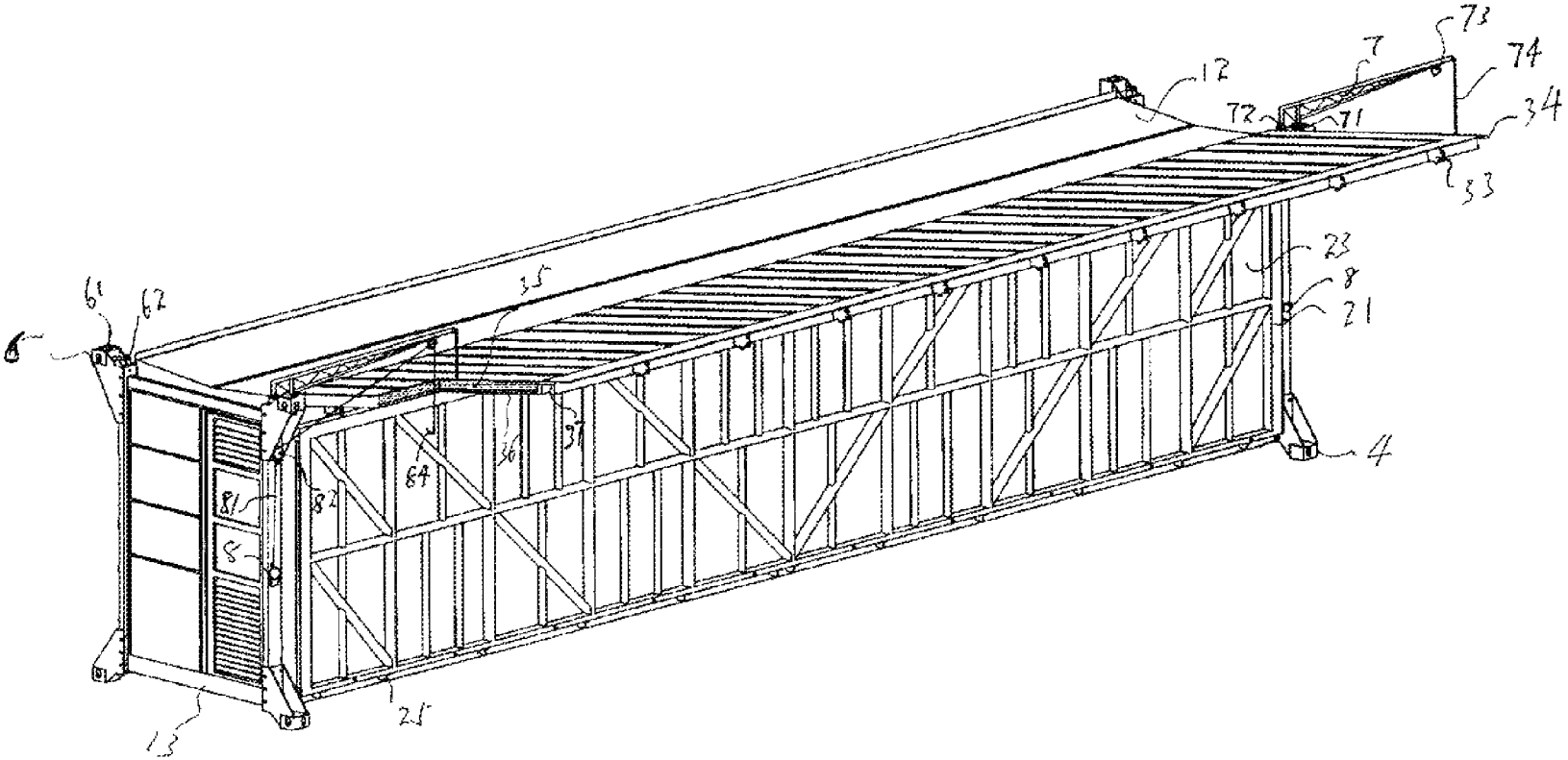
FIG. 2 is a first three-dimensional structural drawing showing the invention in the process of being opened.
Figure 4:
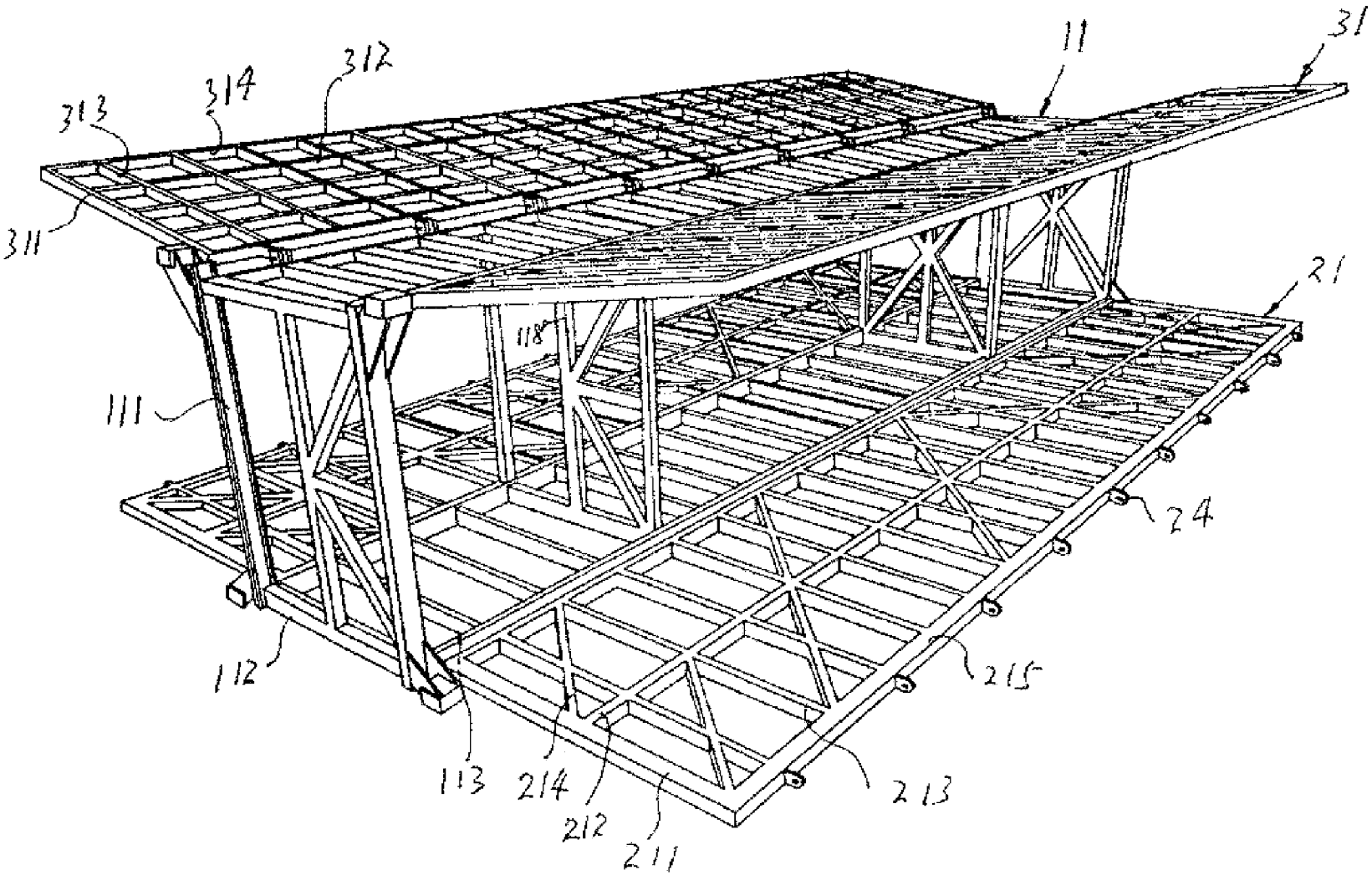
FIG. 4 is a three-dimensional structural drawing showing the framework of the invention in use.
Figure 5:
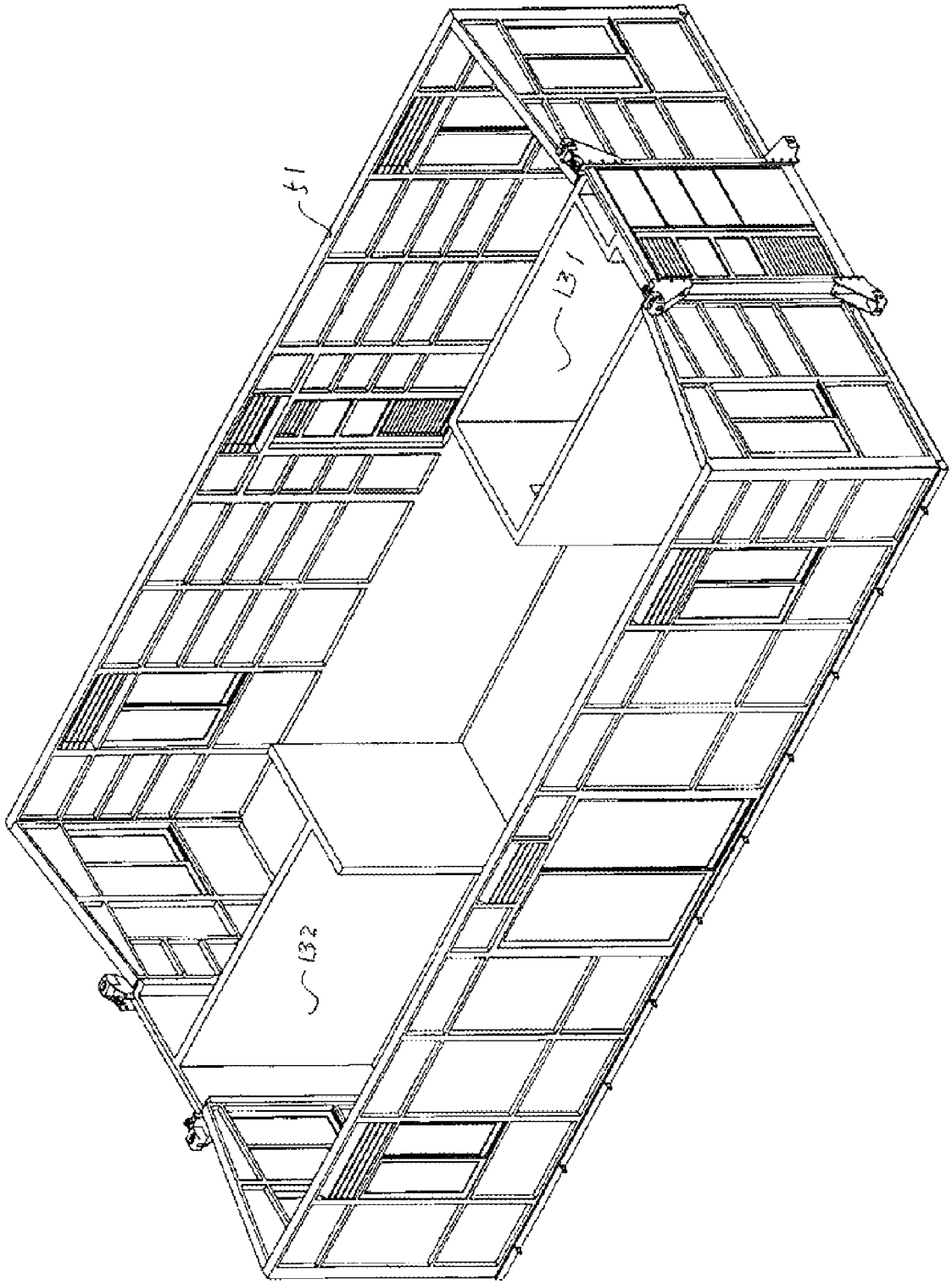
FIG. 5 is a three-dimensional structural drawing showing the interior of the invention in use.

Box 1 that is the principal component of the building: As can be seen in FIGS. 1, 2 and 4 is a rectangular parallelepiped in outward appearance; it includes at least the box frame 11 that is formed by four studs 111, four short transverse beams 112, four lengthwise vertical beams 113, of which the top part is the fixed top plate 12 and the bottom part is the fixed bottom plate 13; fixing frames 6 for the hoisting equipment are disposed at the tops of the two pairs of studs 111.

In this embodiment of the invention as can be seen from FIGS. 6 and 7, the steel structural frame at the top of the box 1 is formed of two lengthwise vertical beams 113 for which [ shaped channel iron is selected and employed, internally welded lateral steel pins 114 and lengthwise channel iron pins 115; the pins 114 are approximately one half the height of the channel iron and the ends of the pins 114 are inserted into the shaped channel iron and are welded and fixed to the bottoms thereof; the end parts of heat insulating batts 112 are bonded and fixed within the shaped channel iron to the tops thereof; the lengthwise sides of the two ends of an integrally formed reinforced glass fibre composite sheet 121 which is the waterproof layer cover the top surfaces of the two lengthwise beams 113 of the fixed top plates, and the aluminium alloy pinch plates 119 that form the interior decorative layer are attached below the steel frame. Fixing plates 15 for the movable bottom plates 2 and tie plates 14 to join the movable top plates are welded and fixed to the outsides of the two lengthwise beams 113.

Movable top plates 3: As can be seen from FIGS. 2, 3, 4 and 7, the steel frames 31 of the movable top plates 3 include two short transverse beams 311, two lengthwise beams 314 and 315, with intersecting transverse pins 313 and lengthwise pins 312 welded to the interiors thereof; several pivots 32 are welded perpendicularly to the interiors of the lengthwise beams 315 and several fixing plates 33 are welded horizontally to the lengthwise beams 314; angle iron is selected and employed for welding and fixing the transverse pins 313 and the lengthwise pins 312 to form the steel structural frame, with the ends of the pins being inserted into the hollows of the short transverse beams 311 and being fixed by welding, and with the ends of the heat insulating batts 35 also being inserted into the channel iron and being bonded and fixed to the tops thereof; coloured steel sheet 34 which is provided with an outer waterproof layer is disposed over the heat insulating batts 35, the aluminium alloy pinch plates that form the interior decorative layer 36 are disposed below the steel structural frame, and the coloured steel sheet 34 extends beyond the steel structural frame and the interior decorative layer 36.

The pivots 32 that are welded to the lengthwise beams 315 on the movable top plates 3 are connected and fixed through single swing pins 320 between the two adjacent tie plates 16 on the fixed top plate, tying the movable top plates 3 to the two sides of the box 1.

Movable top plate 2: As can be seen from FIGS. 2, 3 and 4, the steel frame 21 of the movable top plate 2 includes two short transverse beams 211, two long lengthwise beams 215 and transverse pins 213, lengthwise pins 212 and oblique pins 214 that cross over each other and are welded to the short transverse beams 211 and the long lengthwise beams 215; a damp proof sheet 23 and a timber and bamboo substrate 22 are successively placed over the steel frame 21; there is a fixing plate 24 welded to the outside of the outer lengthwise beam 215 of the movable top plate 2, and a pivot 25 welded perpendicularly to the inside of the inner lengthwise beam 215 of the movable head 2. There are also tie plates welded to the outsides of the two corresponding lengthwise beams 113 of the fixed bottom plate in the box 1, the pivot 25 on the movable bottom plate 2 inserted between two tie plates and is connected and fixed through a swing pin, and the movable bottom plate 2 pivots on one side of the bottom surface of the box 1.

Hoisting device: Includes the boom 7, pulleys 73 and 82, steel wire rope 81 and the electrically powered block 8; as can be seen from FIGS. 1, 2, 3 and 4, hoisting device fixing fixtures 6 that can work with the boom are mounted on the tops of the four corners of the box 1, the fixtures 6 being triangular boxes, being as thick as the widths of the studs 111, and with an insertion socket 61 and a pin joint part 62 being provided on the fixing fixtures 6 used to install the boom 7, an insertion projection part 71 is provided below the near fixing end of the boom 7, such insertion projection part 71 being capable of insertion into the insertion socket 61, and the fixing end 72 of the boom 7 is fixed to the pin joint part 62 by a pin, such structure enabling the rapid assemble and disassembly and operation of the boom 7.

A pulley 73 is provided at the outer end of the boom 7 and single electrically powered blocks 8 are also provided at the tops of the side surfaces of the studs 111 of the box 1, steel wire ropes 81 are coiled around the rotating shafts of the electrically powered blocks 8, fixed pulleys 82 are provided above the electrically powered blocks 8 and hooks 84 are provided at the moving ends of the steel wire ropes 81, the moving ends of the steel wire ropes 81 are threaded through the two pulleys 82 and 73, and couplings 83 for the hooks 84 at the corresponding positions on the top plate 3. When the portable building is erected, the electrically powered blocks 8 are operated, the steel wire ropes 81 are reeled up causing the free end of the top plate 3 to roll over and turn into the desired position, the couplings 83 at the end of the sling 74 at the end of the boom 7 are joined (in FIG. 2, the movable top plate has already been raised, and has been tightened and fixed by means of the sling 74) and the top plate 3 is fixed into the desired position; the side plates 5 are then erected and when erection is complete, the boom 7 and the electrically powered blocks 8 can be dismantled. The process of dismantling the building is simply the reverse of this process. For transportation, the free ends of the movable top plate 3 and of the movable bottom plate 2 can be fixed to the fixing plates 33 and 15 that are welded to the exterior of the box 1 and fixed in place with screws; the boom 7 is used only when the building is erected and dismantled, and can be stored separately at other times.

Figure 3:
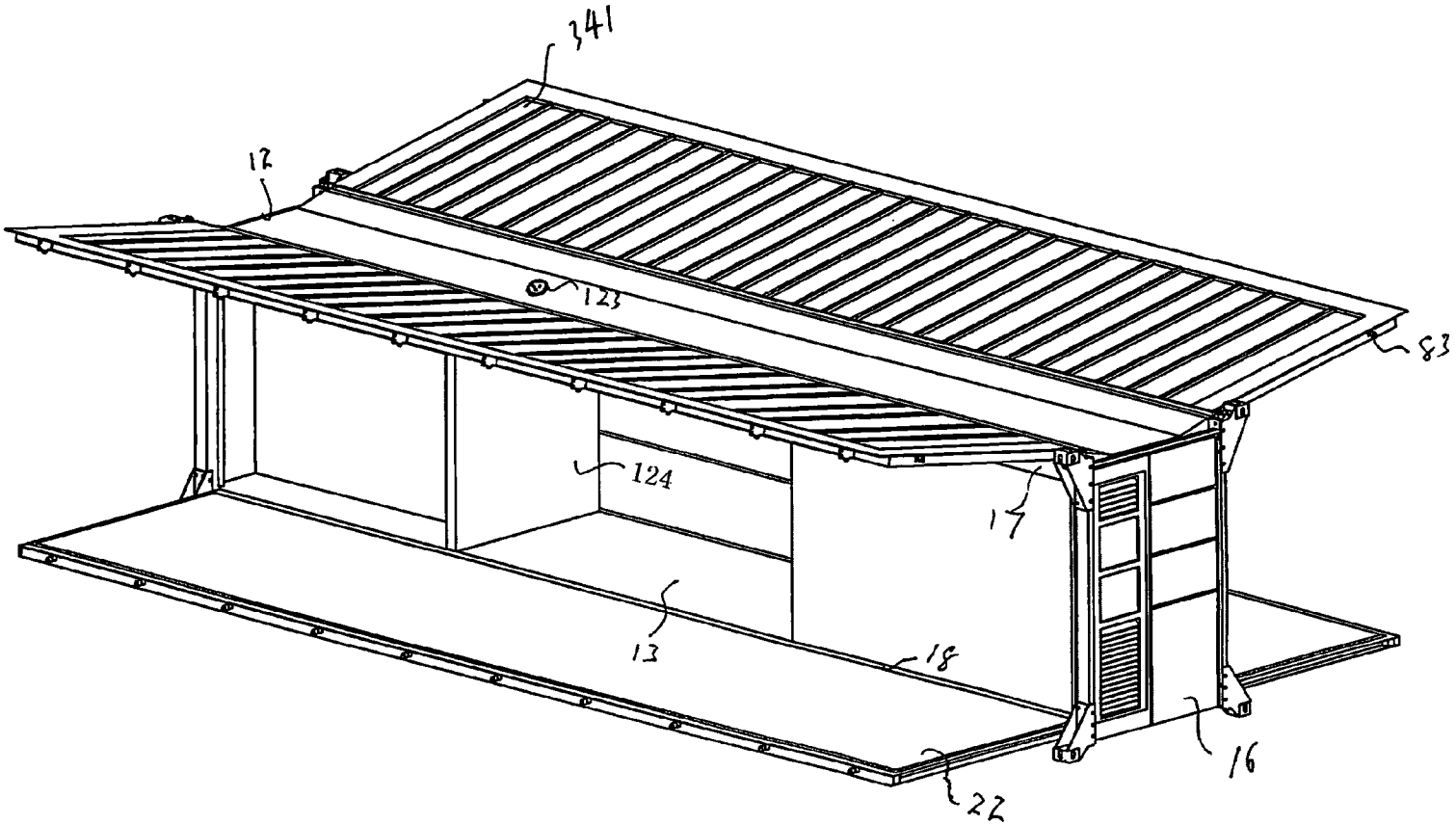
FIG. 3 is a second three-dimensional structural drawing showing the invention in the process of being opened.

As can be seen from FIGS. 1, 2 and 3, when the building is in an open state, the movable top plate 3 is inclined with the side that extends outwards being higher than the fixed side; the gutters 341 that are disposed on the coloured steel sheet 34 and that follow the direction of the slope thereof form troughs at the sides of the top panel of the box 1, and the fixed side of the movable top plate 3 being slightly higher than the top panel of the box 1, the edges 342 of the coloured steel sheet 34 are positioned above the top panel of the box 1 so that, when it rains, the rainwater follows the gutters 341 of the top plate 3 and flows to the top panel of the box 1, and then flows down through the openings in the sides of the top panel.

An exhaust system and rainwater collection system can also be added and provided within the building. The dimensions of the box 1 are able to comply with all the specifications for a standard shipping container.

To summarize the foregoing description of the structure of the portable building, the movement of the portable building includes the following measures:

First, the furniture between the movable top plate 3 and the movable bottom plate 2 is packed in a set sequence and is stacked inside the box 1; the boom 7 is used to fix the top plate 3, the side plates 5 of the side walls are dismantled and are placed inside the box 1; the boom 7 rolls the movable top plate 3 and the movable bottom plate 2 over and lent and fixed against the side surfaces of the box 1 forming a standard shipping container, the boom 7 is dismantled, and the door 16 at the front of the box 1 is stored inside the box 1.

Next, use a mobile crane to hoist the shipping container onto a truck 9, transport the shipping container to the desired side, and use a mobile crane to lower the shipping container onto a suitable surface.

Thirdly, install the boom 7 and use the boom 7 to raise the movable top plate 3 that forms the roof of the building and turn the movable top plate 3 to the set height and fix it; turn the movable bottom plate 2 that forms the floor of the building down to the ground, then install the side plates 5 that form the side panels of the building so that they provide support between the movable top plate 3 and the movable bottom plate 2; the downwards facing openings in the aluminium alloy material 37 on three sides of the movable top plate 3 form gutters, the shapes thereof matching the top parts 51 of the side wall side plates 5, and when the side wall side plates 5 are assembled, the top parts 51 thereof are inserted into and fixed to the gutters 37, with the adjoining side plates 5 being joined by means of stainless steel bolts; finally, the boom 7 is dismantled, the sealing strips 17 are placed around the junction between the fixed top plate 12 and the movable top plate 3, and the floor sealing strips 18 are placed around gap at the junction between the fixed bottom plate 13 and the movable bottom plate 2.

A portion of the electrical cabling for illumination equipment principally passes through the flexible conduits 122 and is previously embedded in the fixed top plate 12, with a portion of the electrical cabling for illumination equipment being led in through the movable top plate 3. A seat 123 for the installation of a wind-power electricity generator is also provided on the fixed top plate 12 (see FIGS. 3 and 4) and a fixed steel frame 118 is also connected and integrated with the steel frame of the box below the installation seat 123 which is able to support either a wind-power electricity generator or alternatively a solar cell electricity generator; the fixed steel frame 118 is disposed within the fixed side wall 124.

A toilet 131 is provided within the building, and an environmentally-friendly toilet is provided within the toilet 131; the fixtures of the toilet 131 and of the kitchen 132 are all mounted on the fixed bottom plate 13, such that it is not necessary to dismantle the water, electricity and gas connections or to remove the fixtures within the building when the building is to be transported.

According to the requirements for the use of the portable building, a seat for a solar-powered electricity generator may also be provided, while a broadband Internet connection, audio cabling and a loudspeaker and so forth may also be provided within the building. A lightning conductor may also be installed on the building.

The foregoing describes one practical embodiment of the invention, but the generality of the invention is not limited thereto.

The structure envisaged by the present invention is logical, convenient to install and employ, can be manufactured in large volumes and is industrially quite feasible.

The invention claimed is:

1. A portable building comprising:

a rectangular cuboid box forming a principal member of the building, the box including at least: a box frame comprising four studs, four short horizontal beams and four lengthwise beams, a fixed top plate at the top thereof; a fixed bottom plate the bottom thereof, and a fixing frame for hoisting equipment at the tops of at least one pair of the studs;

at least one movable top plate forming the roof of the building, one side of the top plate pivoting on an edge of the top of the box, and the top plate being capable of pivoting downwards to rest on a side of the box;

at least one movable bottom plate forming a floor of the building, one side of the bottom plate pivoting on one edge of the bottom of the box, and the bottom plate being capable of pivoting upwards to rest on the side of the box;

at least one side plate forming a side wall of the building, the side plate being capable of being dismantled and providing support between the edges of the top plate and the bottom plate;

at least one set of lighting equipment comprising a cabling part embedded in the fixed top plate and the movable top plate;

at least two hoisting devices that are employed to stow and to open the movable top plate and the movable bottom plate, and the hoisting devices removably mounted in the fixing frame on the studs, and wherein the fixed top plate and the movable top plate provide the roof of the building, and include at least an outer rainproof layer, an internal decorative layer and a steel structural framework, wherein the outer rainproof layer on the fixed top plate is integrally formed of reinforced glass, the two longitudinal sides of the outer rainproof layer enclosing the two lengthwise beams of the fixed top plate and forming a trough shape; the outer rainproof layer of the movable top plate is coloured steel sheet which extends beyond the steel framework and the inner decorative layer of the movable top plate and joins the fixed top plate at the outer side in order to prevent the inflow of rainwater; and wherein a sealing strip is provided at a joint between the fixed top plate and the movable top plate.

2. A portable building as claimed in claim 1, wherein the hoisting devices include booms, pulley blocks, steel wire ropes and electrically powered blocks; wherein pulleys are provided on outer extended ends of the boom, wherein the electrically powered blocks are mounted beneath fixed frames on the studs, wherein the steel wire ropes are wound around the revolving shafts thereof, wherein single hooks are provided at the moving ends of the steel wire ropes, wherein single pulleys are disposed at the tops of the electrically powered blocks, wherein the moving ends of the steel wire ropes are wound through the two pulleys, and wherein hooks are provided on the rim of the movable top plate that engage the pulley blocks.

3. A portable building as claimed in claim 1, wherein the fixed frame forms a triangular box, the thickness thereof being similar to the width of the studs, the top plate possesses an insertion slot and a pin joint part, wherein an insertion knob is provided below the vicinity of the fixed end of the aforementioned boom, and is inserted into the insertion slot, and wherein the fixed end of the boom is fixed to the pin joint through a pin.

4. A portable building as claimed in claim 1, wherein when the movable top plate exhibits a slope in an opened position, wherein the outer side of the movable top plate is higher than the fixed side, wherein the face of the top plate is a corrugated sheet that is provided with gutters following the inclination of the top plate, and wherein the fixed side of the movable top plate is slightly higher than the top surface of the fixed top plate.

5. A portable building as claimed in claim 1, further comprising a kitchen, bathroom, and a parlour.

6. A portable building as claimed in claim 1, wherein the outer rainproof layer of the movable top plate is made of a coloured steel, wherein the inner decorative layer is made of an aluminum alloy pinch plate and wherein heat insulation batts are provided between the coloured steel sheet and the aluminum alloy pinch plate.

7. A portable building as claimed in claim 1, wherein an aluminum alloy material is disposed on three sides of the movable top plate, wherein the downwards opening parts thereof form sliding chutes, the shapes of the sliding chutes being adapted to the tops of the side wall panels of the building, and wherein the tops of the side wall panels are inserted into and fixed in the sliding chutes when the side wall panels are installed.

8. A portable building as claimed in claim 1, wherein the fixed bottom plate and the movable bottom plate comprise steel frames, damp-proof layers, timber boards, bamboo, floorboards, and floorboard sealing strips which are installed at the joints between the fixed bottom plate and movable bottom plate.

9. A portable building as claimed in claim 1, wherein the outer dimensions of the box are identical to those of a standard shipping container.

10. A portable building as claimed in claim 1, wherein the movable top plate and the movable bottom plate pivot on the top edge and the bottom edge of the longer side surfaces of the box, wherein a door is provided in one of the shorter sides of the box, and windows are provided in one of the longer sides of the box.

11. A portable building as claimed in claim 1, wherein the top of the box is provided with a seat for a wind-powered electricity generator, wherein a steel frame that is integrally formed with the steel frame of the box is provided below the seat and wherein a lightning conductor is provided.

12. A portable building as claimed in claim 1, wherein the top of the box is provided with a seat for a solar-powered electricity generator, wherein a steel frame that is integrally formed with the steel frame of the box being provided below the seat.

13. A portable building as claimed in claim 1, wherein an environmentally-friendly toilet is provided inside the box, and wherein broadband Internet cabling, an audio circuit and a loudspeaker are provided within the box.

14. A method of moving the portable building as claimed in claim 1 comprising the steps of:

a) Dismantling the side panels that form the side walls of the building and stowing them inside the box that forms the main part of the building;

b) Turning the top panel and bottom panel that form the roof and the floor to lean against the side surfaces of the box to create a standard shipping container;

c) Employing transport equipment to transport the shipping container to a desired site;

d) Turning and raising the top plate that forms the roof of the building to a specified height and fixing the top plate;

e) Turning and lowering the bottom plate that forms the floor towards the ground; and f) Placing the side plates that form the side walls to provide support between the top plate and the bottom plate.

15. The method as claimed in claim 14, wherein the step of turning and raising the top plate further comprising the steps of:

a) Installing a boom on the top part of the box that forms the main part of the building;

b) Installing and fixing an electrically powered block on the side surface of the box, inserting the free end of the steel wire rope that is wound around the revolving shaft of the electrically powered block through the gyro wheel below the extended end of the boom, and engaging the coupling at the free end of the steel wire rope with the coupling on the top plate; and c) Starting the electrically powered block and raising the steel wire rope, causing the top plate to rise and turn and to lean upon the side surfaces of the box.

* * * * *